United States Patent [19]

Reim et al.

[11] Patent Number: 4,555,424

[45] Date of Patent: Nov. 26, 1985

[54] TEXTILE SHEET WITH SURFACE EFFECTS

[75] Inventors: Ingeborg Reim, Cottbus; Gerhard Pohl, Forst; Wolfgang Götzke, Forst; Dieter Wahnberger, Forst; Lothar Postel, Forst; Irmgard Kindlein, Forst; Rudolf Vatter; Manfred Greschke, both of Cottbus, all of German Democratic Rep.

[73] Assignee: VEB Forst, Lausitz, German Democratic Rep.

[21] Appl. No.: 582,985

[22] Filed: Feb. 24, 1984

[51] Int. Cl.[4] ..... B32B 5/06

[52] U.S. Cl. ..... 428/91; 26/29 R; 28/107; 28/109; 428/234; 428/300

[58] Field of Search ..... 428/91, 234, 300; 26/29 R; 28/107, 109

[56] References Cited

U.S. PATENT DOCUMENTS 4,333,976 6/1982 Okamoto ..... 428/91

*Primary Examiner*—Marion C. McCamish

*Attorney, Agent, or Firm*—Jordan and Hamburg

[57] ABSTRACT

A textile sheet made with improved surface effects and from yarns with typical unfavorable characteristics (firm round yarn cross-section, low hairiness), of the rotor OE (open end), MJS (murate-jet), sirospun or friction yarns, which, as the result of a multiple needle process with the effect of already known felting needles, shows improved properties including a higher volume, a softer touch, is warmer, and has increased tenacity and hairiness than before the finishing process.

15 Claims, No Drawings

TEXTILE SHEET WITH SURFACE EFFECTS

BACKGROUND OF THE INVENTION AND PRIOR ART STATEMENT

The invention concerns textile sheets for clothing, underwear or decoration, preferably of rotor (open-end), MJS (Murata-Jet), sirospun or friction yarns, with yarn strengths typical for carded yarns, showing a nap following a finishing process.

It is known that sheets from yarns with firm round yarn cross-section and low hairiness can be given a surface nap by finishing processes such as abrasion or raising.

It is known, according to DE-OS No. 2522871, that materials for furniture coverings can be given a higher volume via a raising effect produced by multiple needle processes, as well as a higher pulling tenacity.

SUMMARY OF THE INVENTION

Within the intent, ambit and scope of the present invention, it will be understood that the term "sheet" or "textile sheet" also encompasses and includes a woven fabric, knits, warp knits, thread layer materials, or the like textile and/or cloth materials.

It is an object of the invention to provide a sheet from rotor (open-end), MJS (Murata-Jet), sirospun or friction yarns, without the typical disadvantages of the firm round yarn cross-sections and the low hairiness. High losses as regards tenacity and material are avoided, and the number of finishing processes is reduced. The elimination of defects such as thick spots, slubs, wrong lifts, narrow local color differences within the sheet or the area are eliminated, or covered by a nap.

Thus it is an object of the invention to provide a sheet from yarns with firm round yarn cross-section and minimal hairiness, in which, following a highly effective finishing process, the typical unfavorable characteristics of, for example, the OE (open-end), MJS (Murata-Jet), sirospun or friction yarns, are absent or considerably reduced. Additionally, effects are present, which can only be produced in the prior art by several finishing processes with high material and tenacity losses.

These and other objects and advantages of the present invention will become evident from the description which follows.

DETAILED DESCRIPTION OF THE PREFERRED EMBODIMENTS

In summary, the invention concerns a textile sheet with improved surface effects and made from yarns with typical unfavorable characteristics (firm round yarn cross-section, low hairiness), of the rotor OE (open end), MJS (Murata-Jet), siro-spun or friction yarns, which, as the result of a multiple needle process with the effect of already known felting needles, shows improved properties including a higher volume, a softer touch, is warmer, and has increased tenacity and hairiness than before the finishing process.

Thus, the present invention is characterized by the provision of a textile sheet with surface effects for clothing underwear or decoration, preferably in the form of a woven fabric, knits, warp knits or thread layer materials, the textile sheet being composed from yarns of yarn strengths typical for carded yarns, in which fiber ends and/or loops project in the stitch direction of felting needles and from the yarn mantle as hairs in the sheet, and typically from the yarn mantle of rotor (open end), MJS (Murata-Jet), sirospun, or friction yarns of the thread system; the fiber ends and/or loops alternatively originating in the firm fiber core of the yarn, other positions of the yarn cross-section, or in the yarn mantle itself, with the several fiber parts of the thread system projecting from the yarn mantle, and penetrating the entire thickness of the sheet.

Typically, in a preferred mode, the textile sheet with surface effects entails a configuration in which the displacement of the fiber parts, originating in the full yarn cross-section, extends from the yarn mantle with a high portion, throughout the thread system up to the nap, in the stitch direction of the felting needles of a finishing device, and preferably perpendicular to the surface extension.

The object is accomplished in the invention in that the sheet consisting of threads of yarn strengths typical for carded yarns, having the typical characteristics of the rotor (open-end), MJS (Murata-Jet), sirospun or friction yarns, i.e., round firm yarn cross-section, stomach binder or sugartop effects, receives and obtains altered threads with, and characterized by, a high degree of hairiness and larger volume, as well as a nap on one or two surfaces, as the result of a multiple needle process. The perforation frequency of the felting needles is 50 to 500/cm$^2$. From the mantle of the yarn of the sheet, fibers project or penetrate other neighboring threads in the stitch direction of the felting needles of a known multiple needle apparatus; the fibers originating in the firm fiber core of the yarn, or in the yarn mantle itself. The projecting fiber parts can be removed from the fiber core of the yarn by means of the felting needles, over the entire thickness of the sheet, by crossed threads to the surface of the sheet. On the surface of the yarn mantle, all projecting fiber parts result in an increased hairiness, a nap on the surface of the sheet, the length and thickness of which depend on the depth of the stitches and the frequency of the felting needles. At those points where fiber parts have been pulled out of the yarn, there is a loosening of the yarn structure and a higher volume of the yarn, at lower fiber volume per cm$^2$.

The needled sheets have a higher volume, a softer touch, are warmer, have increased tenacity and hairiness than before the finishing process, as well as a nap (at low material losses).

It thus will be seen that there is provided a textile sheet with surface effects which attains the various objects of the invention, and which is well adapted for the conditions of practical use. As numerous alternatives within the scope of the present invention, besides those alternatives, variations, embodiments and equivalents mentioned supra, will occur to those skilled in the art, it will be understood that the present invention is to be limited only by the scope and content of the recitations in the appended claims, and functional and structural equivalents thereof. In addition, it will be understood by those skilled in the art, that the present invention encompasses and includes not only the textile sheet per se, as a new article of manufacture, but it will be appreciated that the invention also includes the present new method for the production of the new textile sheet.

We claim:

1. A finished textile sheet having surface effects including one or more of threads with a high degree of hairiness, a larger volume of the yarn, a nap (at low material losses) on one or both surfaces, a loosening of the yarn structure, lower fiber volume per square centimeter, a higher volume, a softer touch, a warmer surface effect, increased tenacity and hairiness, and a higher sheet volume, which comprises a product textile sheet having at least one specific surface effect, and being derived from an initial textile sheet, said initial textile sheet including yarns or threads of strengths typical for carded yarns, and having a firm round yarn cross-section and low or minimal hairiness, stomach binder, and/or sugartop effects, said yarns or threads of said initial textile sheet having a mantle and fibers or fiber parts, said fibers or fiber parts being displaced from said yarns or threads as fiber ends and/or loops, and penetrating and extending into at least one surface of said initial textile sheet, said fibers or fiber parts being displaced at least partially through the entire thickness of said initial textile sheet, and filling the spaces between said yarns or threads, said fiber ends and/or loops projecting from said yarn mantle as hairs in said product textile sheet.

2. The textile sheet of claim 1, in which the initial textile sheet contains yarns or threads selected from the group consisting of rotor (open end), MJS (Murata-Jet), sirospun, and friction yarn.

3. The textile sheet of claim 1, in which the fibers or fiber parts originate from and are derived from the firm fiber core of the yarn, the yarn mantle, other positions of the yarn cross-section, the full yarn cross-section, and/or from within the yarn mantle itself.

4. The textile sheet having specific surface effects of claim 1, in which the fiber ends and/or loops extend substantially perpendicularly to the surface of the product textile sheet.

5. The textile sheet article of manufacture of claim 1, in which the displaced fibers or fiber parts, which originate in the full yarn cross-section, extend from the yarn mantle with a high portion, and throughout the thread or yarn system up to a nap or the like, and in the direction of penetration of the surface of the initial textile sheet.

6. A method for the finishing of a textile sheet to produce surface effects including one or more of threads with a high degree of hairiness, a larger volume of the yarn, a nap (at low material losses) on one or both surfaces, a loosening of the yarn structure, lower fiber volume per square centimeter, a higher volume, a softer touch, a warmer surface effect, increased tenacity and hairiness, and a higher sheet volume, which comprises:

(a) providing an initial textile sheet, said initial textile sheet including yarns or threads of strengths typical for carded yarns, and having a firm round yarn cross-section and low or minimal hairiness, stomach binder, and/or sugartop effects, said yarns or threads having a mantle and fibers or fiber parts;

(b) displacing said fibers or fiber parts of said yarns or threads from said yarns or threads as fiber ends and/or loops, and concomitantly penetrating at least one surface of said initial textile sheet with said fibers or fiber parts, and displacing said fibers or fiber parts at least partially through the entire thickness of said initial textile sheet, thereby filling the spaces between said yarns or threads with said fibers or fiber parts, and so that said fiber ends and/or loops project from said yarn mantle as hairs in said textile sheet; and (c) recovering a finished textile sheet, said finished sheet having at least one specific surface effect, due to step (b).

7. The method of claim 6, in which the initial textile sheet comprises yarns or threads selected from the group consisting of rotor (open end), MJS (Murata-Jet), sirospun, and friction yarn.

8. The method of claim 6, in which the fibers or fiber parts of step (b) originate from and are derived from the firm fiber core of the yarn, the yarn mantle, other positions of the yarn cross-section, the full yarn cross-section, and/or from within the yarn mantle itself.

9. The method of claim 6, in which step (b) comprises the perforation of the surface of the initial textile sheet with a plurality of needles.

10. The method of claim 9, in which the perforation frequency of the needles is in the range of about 50 to 500 per square centimeter.

11. The method of claim 9, in which the needles are felting needles of a multiple needle apparatus.

12. The method of claim 9, in which the fiber ends and/or loops of the fibers or fiber parts project in the stitch direction of the needles.

13. The method of claim 9, in which the plurality of needles perforate the surface of the initial textile sheet by passing substantially perpendicularly to the surface of the initial textile sheet.

14. The method of claim 6, in which the fiber ends and/or loops extend substantially perpendicularly to the surface of the textile sheet.

15. The method of claim 6, in which the displacement of the fibers or fiber parts, which originate in the full yarn cross-section, extends from the yarn mantle with a high portion, and thoughout the thread or yarn system up to a nap or the like, and in the direction of penetration of the surface of the initial textile sheet.

* * * * *